US005655499A

United States Patent [19]

Uehara et al.

[11] Patent Number: 5,655,499

[45] Date of Patent: Aug. 12, 1997

[54] DECOMPRESSION BRAKING APPARATUS FOR DIESEL ENGINE

[75] Inventors: Hirokazu Uehara; Seiji Tsuruta; Akio Akasaka, all of Atsugi, Japan

[73] Assignee: Unisia Jecs Corporation, Atsugi, Japan

[21] Appl. No.: 663,701

[22] Filed: Jun. 14, 1996

[30] Foreign Application Priority Data

Jun. 15, 1995 [JP] Japan ..... 7-148854

[51] Int. Cl.[6] ..... F02D 13/04; F01L 13/06

[52] U.S. Cl. ..... 123/321

[58] Field of Search ..... 123/321, 322, 123/90.16

[56] References Cited

U.S. PATENT DOCUMENTS

| | | | |
|---|---|---|---|
| 2,002,196 | 5/1935 | Ucko | 123/321 |
| 5,036,810 | 8/1991 | Meneely | 123/321 |
| 5,088,460 | 2/1992 | Exheverria | 123/322 |
| 5,564,385 | 10/1996 | Hakansson | 123/321 |

FOREIGN PATENT DOCUMENTS

| | | | |
|---|---|---|---|
| 2-96406 | 8/1990 | Japan | 123/321 |
| 6-17632 | 1/1994 | Japan | 123/321 |

*Primary Examiner*—Raymond A. Nelli
*Attorney, Agent, or Firm*—Foley & Lardner

[57] ABSTRACT

In a decompression braking apparatus which is applicable to a Diesel engine and is capable of switching an engine braking condition so as to achieve an engine revolution speed area when a decompression braking request is issued, a sleeve portion of an eccentric bushing member is pivotally interposed between an inner periphery of a rocker arm and an outer periphery of a rocker shaft fitted into the rocker arm so as to be enabled to displace a swing center of the rocker arm toward a downward direction aligned with an open direction of an exhaust valve whose degree of openings in a closure stroke thereof is varied, a first actuator is so constructed and arranged as to actuate the eccentric bushing member to be pivoted so that the swing center of the rocker arm is displaced to a second position at which the degree of openings of the exhaust valve in the closure stroke is relatively large and a second actuator is so constructed and arranged as to limit the pivotal movement of the eccentric bushing member according to the actuation by means of the first actuator so that the swing center of the rocker arm is displaced to a first position at which the degree of openings of the exhaust valve during the closure stroke is relatively small.

7 Claims, 5 Drawing Sheets

DECOMPRESSION BRAKING APPARATUS FOR DIESEL ENGINE

BACKGROUND OF THE INVENTION

1. Field of the Invention

The present invention relates to a decompression braking apparatus for a Diesel engine used as an engine braking apparatus so as to secure a continuous deceleration of a vehicle in which the Diesel engine is mounted during the vehicular run on a long descending slope independently of using a normally used braking apparatus.

2. Description of the Background Art

An engine braking has widely been applied to an industrial vehicle such as an automotive vehicle other than a forced braking through a normally used braking apparatus and a parking braking apparatus.

A Japanese Patent Application First Publication No. Heisei 6-17632 published on Jan. 25, 1994 exemplifies a first previously proposed decompression braking apparatus for a Diesel engine mounted in a vehicle.

A Japanese Utility Model Registration Application First Publication No. Heisei 2-98408 published on Aug. 1, 1990 exemplifies a second previously proposed decompression braking apparatus for the same.

In the second previously proposed decompression braking apparatus disclosed in the latter Japanese document, with a valve stem of one of a pair of exhaust valves of each cylinder of the Diesel engine extended, a stopper arm is positioned so as to interfere with the exhaust valve stem of the corresponding one of the exhaust valves, the stopper arm being projected from a hydraulic pressure cylinder, so that a closed state of the corresponding one of the exhaust valves in a closure stroke thereof is limited to a state immediately before a completely closed state, thus achieving a decompression operation of the Diesel engine.

In the first previously proposed decompression braking apparatus disclosed in the former Japanese document, a special profile of a cam lobe of a cam shaft to control the open and closure of the corresponding exhaust valve is set, a rocker arm is provided in association with the specially profiled cam lobe, and an eccentric bushing member is provided so as to be enabled to displace a swine center of the rocker arm. Then, a lever portion of the eccentric bushing member is pivoted in response to a plunger motion according to an actuation of an associated actuator so as to displace the swing center of the rocker arm, thus a degree of openings in the exhaust valve during the closure stroke is switched so as to achieve the decompression braking.

In the second previously proposed decompression braking apparatus, the degree of openings in the exhaust valve during a closure stroke thereof (a spatial quantity by which the exhaust valve in the closed state is held to be slightly open) is constant irrespective of an engine revolution speed at which a decompression braking request is issued.

In the first previously proposed decompression braking apparatus, on the other hand, the vehicular braking state is limited to two states of the decompression braking apparatus and the normally used braking application. The degree of the openings in the exhaust valve during the closure stroke thereof is not varied according to the engine revolution speed at which the decompression braking request is issued, namely according to whether the engine revolution speed is within a relatively high speed area or a relatively low speed area.

It is desired that the degree of the openings in the exhaust valve during its closure stroke as a requirement that the decompression braking apparatus can achieve is relatively small when the engine revolution speed is relatively low and is relatively large when the engine revolution speed is relatively high in terms of en appropriate decompression braking force. However, a heavy burden is imposed on a valve train of the Diesel engine when the degree of openings in the exhaust valve during its closure stroke is set to the relatively small value with the engine revolution speed in the relatively high speed area.

Therefore, in each of the first and second previously proposed decompression braking apparatus, the degree of the openings in the exhaust valve during its closure stroke cannot help being set to the relatively large value (to a value in the case of the high engine revolution speed).

Consequently, the decompression braking force exhibited during the relatively low engine revolution speed accordingly becomes deficient.

SUMMARY OF THE INVENTION

It is, therefore, an object of the present invention to provide a decompression braking apparatus for a Diesel engine which can achieve an appropriate braking force applied to a vehicle in which the Diesel engine is mounted according to an engine revolution speed within a heavy burden imposed on a valve train of a corresponding exhaust valve of each engine cylinder.

The above-described object can be achieved by providing a decompression braking apparatus for a Diesel engine, each cylinder of said Diesel engine having a valve train comprising a rocker arm swingably supported by a rocker shaft so as to open and close an exhaust valve with a swing center of said rocker arm as a center, the swing center of said rocker arm being normally aligned with an axial center of said rocker shaft, said decompression braking apparatus comprising:

a) an eccentric bushing member having a sleeve portion pivotally interposed between an inner periphery of a hole of said rocker arm and an outer periphery of said rocker shaft fitted into said hole of said rocker arm so as to be enabled to displace the swing center of said rocker arm in a direction aligned with an opening direction of the exhaust valve;

b) a first actuator having a first plunger whose upper end is enabled to be brought in touch with an end of a sleeve portion of said eccentric bushing member and which is so constructed and arranged as to actuate said eccentric bushing member to be pivoted via said first plunger, thus the swing center of said rocker arm being displaced in a downward direction to a second position aligned with the open direction of said exhaust valve so that a degree of openings of the exhaust valve during a closure stroke is relatively large; and c) a second actuator having a second plunger and which is so constructed and arranged as to project said second plunger to bring said second plunger in touch with the lever portion of said eccentric bushing member such that a pivotal motion of said eccentric bushing member according to the actuation of said first actuator via said first plunger is limited, thus the swing center of said rocker arm being displaced in the downward direction to a first position aligned with the open direction of said exhaust valve so that the degree of the openings of the exhaust valve during the closure stroke is relatively small, said second position being lower than the first position.

BEST MODE FOR CARRYING OUT THE INVENTION

Reference will hereinafter be made to the drawings in order to facilitate a better understanding of the present invention.

Figure 1A:
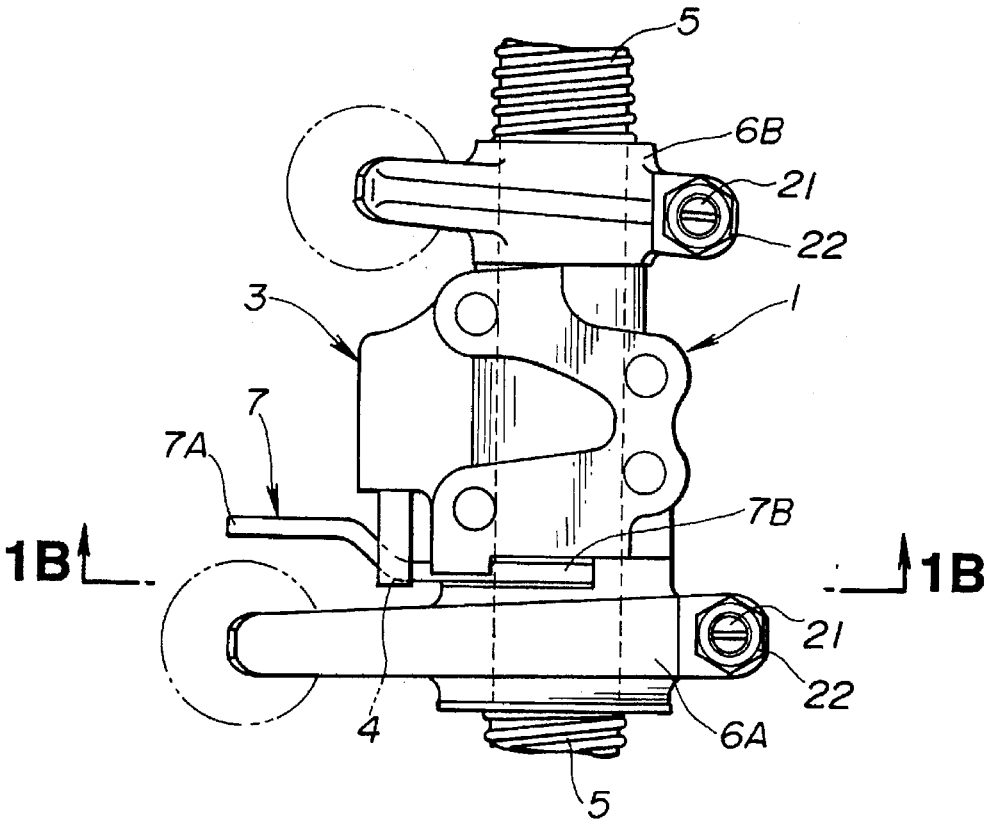
FIG. 1A is a partial top view of a cylinder head of a Diesel engine to which a decompression braking apparatus according to the present invention is applicable for explaining a relationship between a second actuator, a first actuator, and an eccentric bushing member.
Figure 1B:
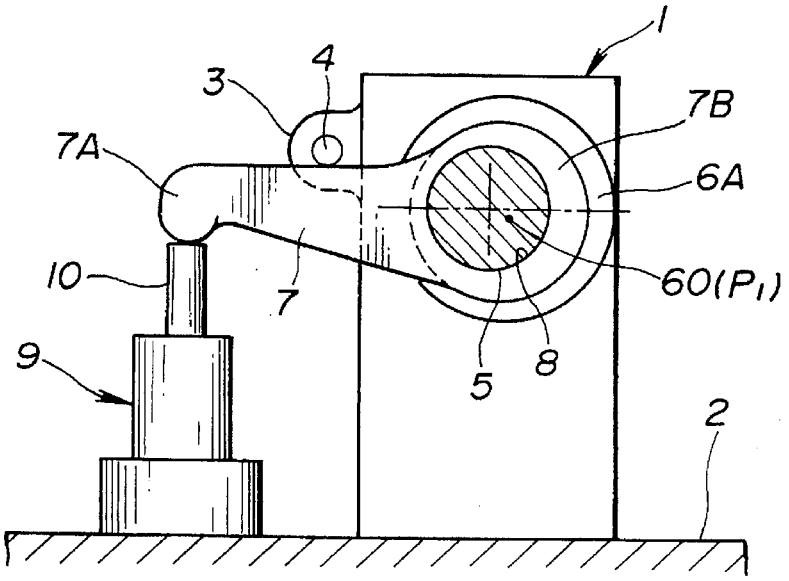
FIG. 1B is an explanatory side cross sectional view cut away along a line of 1B—1B in FIG. 1A for explaining positional relationships of a first (hydraulic pressure) actuator with a first plunger to a rocker arm of a valve train and of a second (hydraulic pressure) actuator with a second plunger to the rocker arm of the valve train.

FIGS. 1A and 1B show a preferred embodiment of a decompression braking apparatus for a Diesel engine according to the present invention when a decompression braking is applied to the Diesel engine during a relatively low engine revolution speed (when the present engine revolution speed is in a low speed area with application of the decompression braking.

In FIGS. 1A and 1B, a bracket 1 is attached onto a cylinder head 2, an actuator (second actuator) 3 is extended from the bracket 1 and is hydraulically operated in response to a decompression braking request to a vehicle in which the Diesel engine is mounted when the engine revolution speed is in the low speed area as will be described later, and a (second) plunger 4 extended from the second actuator 3, the functions of the plunger 4 and its actuator 3 being described later.

A rocker shaft 5 is axially supported on the bracket 1 and is extended over the cylinder head 2 of the Diesel engine.

A rocker arm 6A is swingably supported on the rocker shaft 5 via an eccentric lever 7. On the other hand, a sleeve of another rocker arm 6B is directly and swingably supported on the rocker shaft 5. The term swingably means that each rocker arm 6A and 6B is supported on the shaft 5 so as to be enabled to swing about its swine center like a swing arm (lever). In the Diesel engine shown in FIGS. 1A and 1B, two exhaust valves are installed for each engine cylinder of the Diesel engine. One of the two exhaust valves is regulated so as to receive a decompression braking action via the rocker arm 6A. A circle formed with a phantom line of FIG. 1A generally corresponds to each exhaust valve.

The eccentric lever 7 is an eccentric (bush) member having a sleeve portion 7B pivotally incorporated into the rocker arm 6A and which can actuate to make eccentric a relatively supported position of the rocker arm 6A to the rocker shaft 5, i.e., a swing center 60 of the rocker arm 6A in at least a downward direction as viewed from FIG. 1B. The eccentric lever 7 has a lever portion 7A projected toward the corresponding exhaust valve as shown in FIG. 1B and has the sleeve portion 7B arranged for holding the rocker arm 6A to be enabled for the swine center 60 of the rocker arm 6A to be made eccentric. The rocker shaft 5 is axially fitted into a shaft supporting hole 8 formed on the rocker arm 6A and penetrated at an eccentrically formed position of the sleeve portion 7B and the rocker arm 6A is swingably fitted onto an outer peripheral portion of the sleeve 7B with its swing center 60 of the rocker arm 6A aligned with an axial center of the rocker shaft 5 during the normal driving of the Diesel engine with no decompression braking. It is noted that the swing center 60 of the rocker arm 6A is slightly displaced in a downward direction to a first point ($P_1$) in the case of FIG. 1B.

Referring to FIG. 1B, a first actuator 9 is hydraulically operated in response to a decompression braking request during an engine low revolution speed and during an engine high revolution speed as will be described later and a (first) plunger 10 is extended from the first actuator 9.

Figure 4:
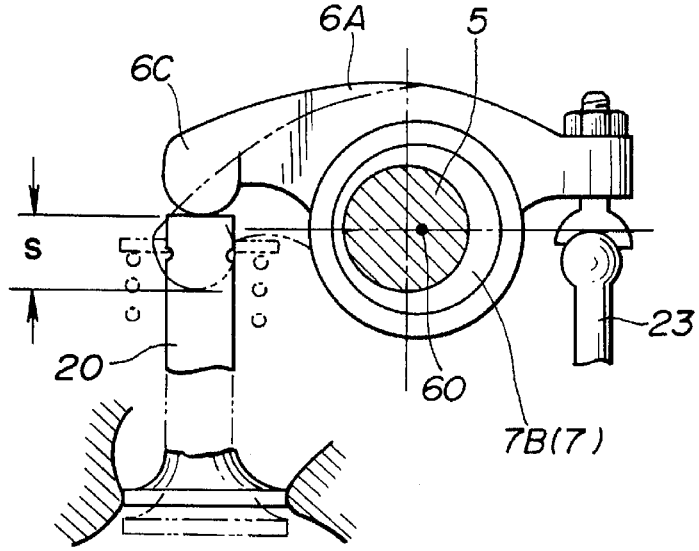
FIG. 4 is an explanatory view for explaining a lift stroke of the exhaust valve with a swing center of a rocker arm aligned with an axial center of the rocker shaft.

In FIG. 1A, reference numeral 21 denotes a screw and numeral 22 denotes a nut, both being used to adjust a valve clearance of the corresponding exhaust valve. A push rod 23 is linked to the screw 21 as shown in FIG. 4.

Figure 2:
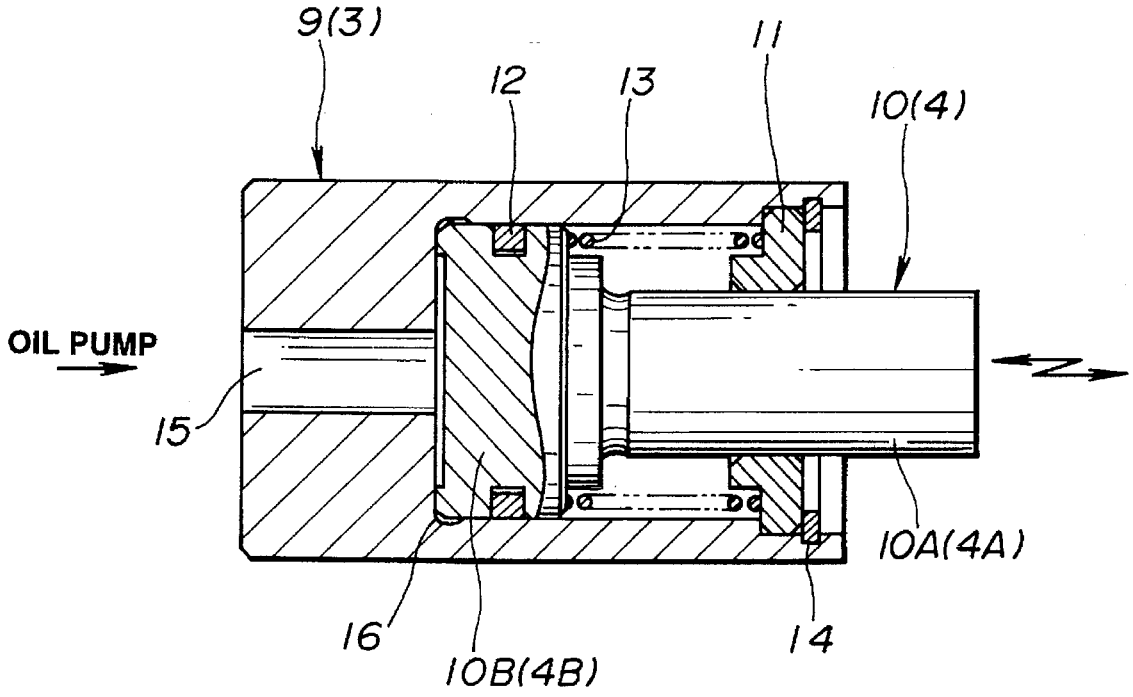
FIG. 2 is a cross sectional view of the first actuator (and the second actuator) used in the embodiment of the decompression braking apparatus shown in FIGS. 1A and 1B.

FIG. 2 shows a structure of each of the first and second actuators 9 and 3.

Each of the first and second actuators 9 and 3 is provided with the corresponding one of the plungers 10 and 4. Each small-diameter portion of the corresponding one of the first and second plungers 4 and 10 is slidably held by means of a guide member 11. In FIG. 2, reference numeral 12 denotes a seal ring fitted to a large-diameter portion 4B and 10B of each plunger 4 and 10, reference numeral 13 denotes a return spring interposed between the guide member 11 and the large-diameter portion 4B and 10B, reference numeral 14 denotes a stopper ring used to fix the guide member 11 onto the corresponding wall of the corresponding one of the actuators 9 and 3, and reference numeral 15 denotes a hydraulic pressure (oil) passage (first oil passage and second oil passage) arranged for introducing a hydraulic pressure supplied from an oil pump (not shown in FIG. 2) to a hydraulic chamber 16 of each of the first and second actuators 9 and 3. As described above, the first actuator 9 has the same structure as the second actuator 3.

In either of the first or second actuator 9 or 3, the hydraulic pressure is supplied to the hydraulic pressure chamber 16 of the corresponding one of the actuators 9 and 3 so that the corresponding plunger 10 or 4 is projected from its corresponding cylinder portion when the engine is at the high or low speed area, the engine braking demand occurring. At this time, the swing center 60 of the rocker arm 6A can be displaced via the lever member 7.

In addition, when such a decompression braking demand as described above is released, a control valve interposed between the oil pump and the hydraulic pressure circuit (passage of 15) is operated to halt the hydraulic pressure supply to the hydraulic chamber 16 so that the working oil is returned from the chamber 16 to the oil pump. At this time, the plunger 10 or 4 is retracted toward the cylinder portion due to a spring force of the return spring 13. Together with a reaction force of a valve spring wound about the exhaust valve causes the rocker arm 6A and the lever member 7 to initially set positions thereof.

Figure 3:
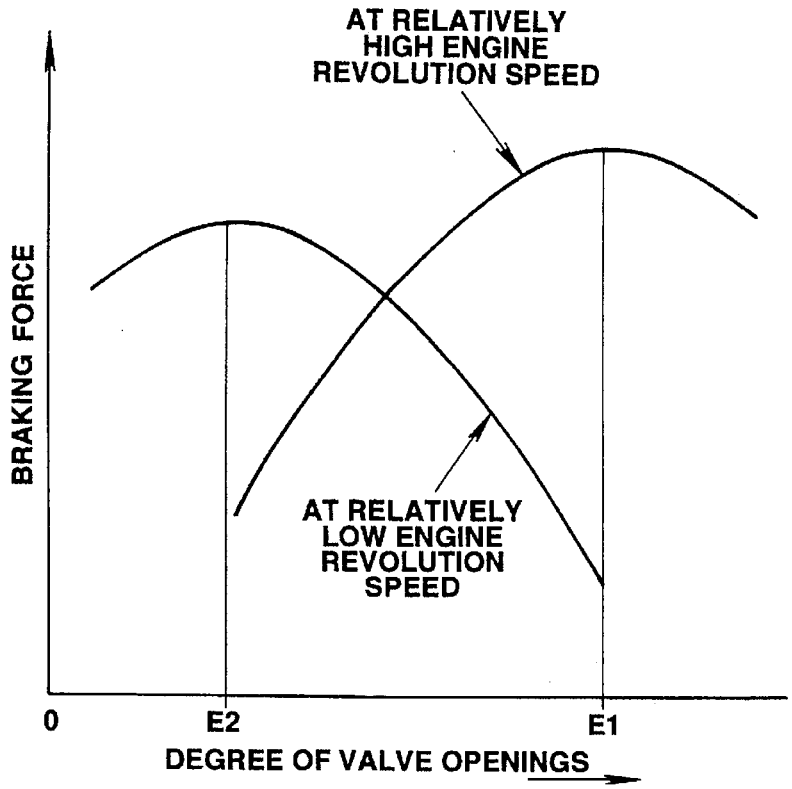
FIG. 3 is characteristic graphs representing relationships between an engine braking force and a degree of openings in an exhaust valve in closure stroke thereof in cases when an engine revolution speed falls in a relatively high speed area and when the engine revolution speed falls in a relatively low speed area.

FIG. 3 shows relationships between an engine braking force and a degree of limitation on an opening of the exhaust valve during a final stroke of the valve opening at the exhaust valve related to the decompression brake (a degree of opening) at the engine low speed area and at the engine high speed area.

As shown in FIG. 3, the engine braking force exhibits its maximum value when the degree of valve openings in the closure stroke is held at relatively small value E2 in a case where the engine revolution speed is at the relatively low speed area and the engine braking force exhibits its maximum value when the degree of valve openings in the closure stroke is held at relatively large value E1 in a case where the engine revolution speed is at the relatively high speed area.

Hence, in the decompression braking apparatus according to the present invention, the swing center 60 of the rocker arm 6A is displaced via the lever member 7 according to the engine revolution speed during the occurrence of the engine braking request so as to hold the degree of valve openings at E1 when the engine revolution speed falls in the relatively high speed area and so as to hold the degree of valve openings at E2 when the engine revolution speed falls in the relatively low speed area.

As described above, the displacement of the swing center 60 of the rocker arm 6A permits change in the degree of valve openings at the relatively low speed area of the engine revolution speed and at the relatively high speed area of the engine revolution speed in a final stroke of valve closures in the corresponding exhaust valve of the Diesel engine as will be described later.

FIG. 4 shows a positional relationship between a valve stem 20 of the exhaust valve, the rocker arm 6A, the eccentric lever 7, and the push rod 21 of the Diesel engine to which the decompression braking apparatus according to the present invention is applicable when no decompression braking force is applied, i. e., when the engine is normally driven. In FIG. 4, S denotes a lifting stroke of the exhaust valve to be decompression controlled.

It is noted that a cam lobe of a cam shaft is associated with the push rod 21 of FIG. 4.

When the push rod 21 is vertically moved to swing the rocker arm 6A by means of the cam, one end of the rocker arm denoted by 6C pushes and is pulled by (vertically moves) an upper end of the valve stem 20 of the exhaust valve so as to achieve the lifting stroke S.

With the valve train shown in FIG. 4 maintained and the occurrence of the decompression braking request at the relatively low engine revolution speed, the second actuator 3 is operated during the valve opening stroke caused by the rocker arm 6A so that the plunger 4 is projected toward the eccentric lever 7 by means of its supplied hydraulic pressure as shown in FIG. 1A, thus the swing center 60 of the rocker arm 6A being displaced via the eccentric lever 7 during the final stroke of the valve closures of the exhaust valve.

That is to say, the pivotal movement of the eccentric lever 7 due to the projection of the first plunger 10 of the first actuator 9 and the projection of the second plunger 4 of the second actuator 3 limits the further pivotal movement of the eccentric lever 7. Consequently, the swing center 60 of the rocker arm 6A is displaced to a slightly lower position ($P_1$) as viewed from FIG. 1B and, thus, the valve stem 20 of the exhaust valve being limited to a (slight open) state immediately before a complete valve closed state. This limitation causes the exhaust valve to be held at the state where a slight degree of the valve openings in closure stroke is held. It is noted that, at this time, no disturbance occurs for the operation of the valve openings by means of the rocker arm 6A.

Next, the operation of the decompression apparatus in a case where the decompression braking request occurs when the engine revolution speed falls in the relatively high speed area will be described below.

Suppose now that the decompression braking request occurs when the engine revolution speed falls in the relatively high speed area with the operating state of the rocker arm 6A during the engine normally driven as shown in FIG. 4, only the first actuator 9 is hydraulically operated to be driven in place of the operation of the second actuator 3.

Figure 5A:
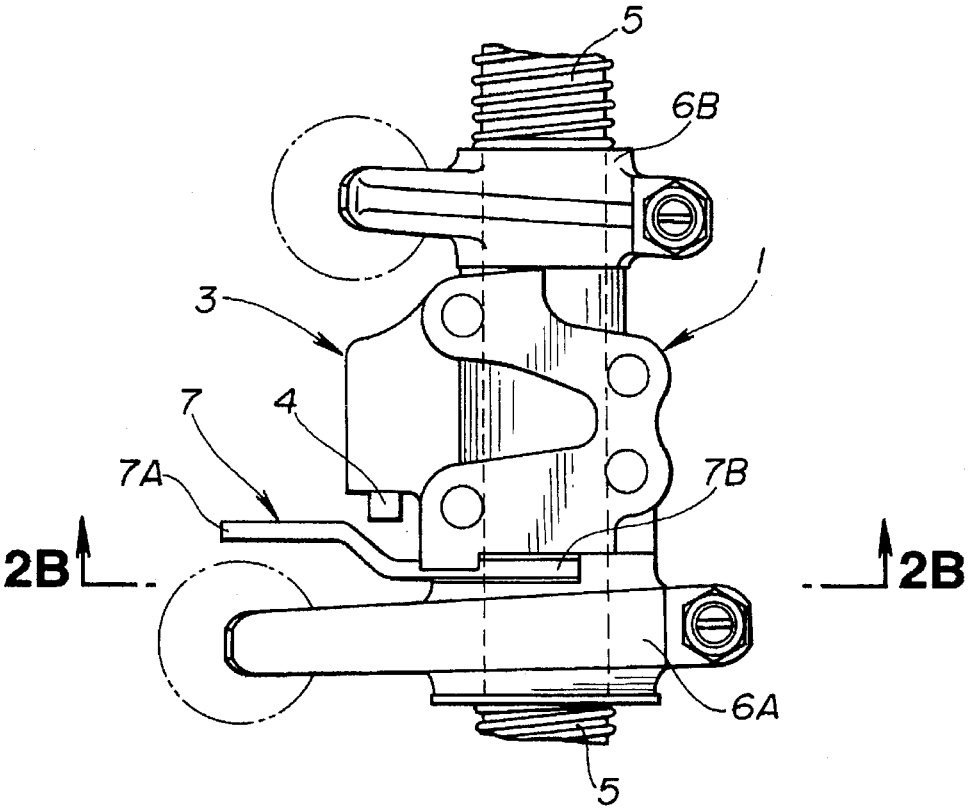
FIG. 5A is the partial top view of a cylinder head of a Diesel engine to which a decompression braking apparatus according to the present invention is applicable for explaining the relationship between the second actuator, the first actuator, and the eccentric bushing member in a case where a decompression braking request is issued and the engine revolution speed falls in the relatively high speed area.
Figure 5B:
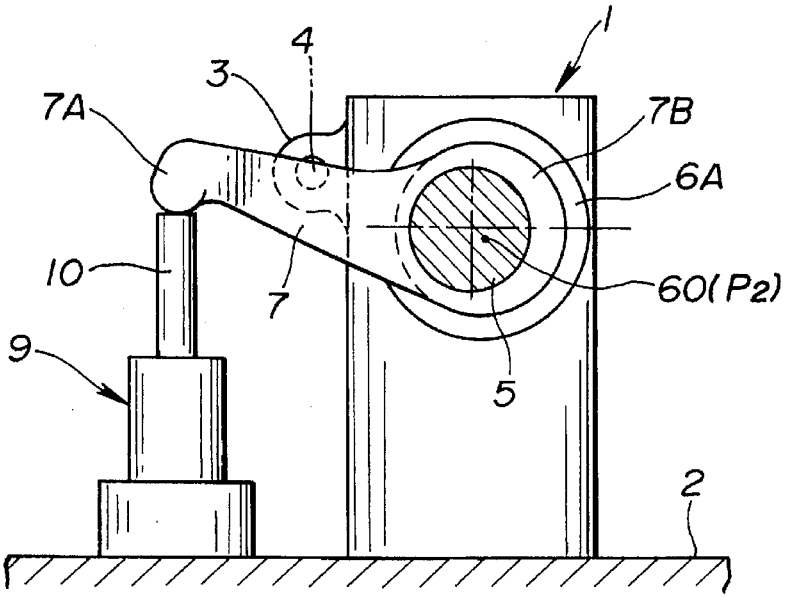
FIG. 5B is an explanatory side cross sectional view cut away along a line of 2B—2B in FIG. 5A for explaining positional relationships of the first actuator with the first plunger to the rocker arm of the valve train and of the second actuator with the second plunger to the rocker arm of the valve train.

FIGS. 5A and 5B show the decompression braking apparatus for the Diesel engine when the decompression braking force is requested during the relatively high speed of the engine revolution speed.

As shown in FIG. 5B, the plunger 4 of the second actuator 3 is retracted due to the spring force of the return spring 13 at a retracted position at which the pivotal operation of the eccentric lever 7 is not disturbed due to the drainage (or halt) of the hydraulic pressure from the hydraulic chamber 16 of the second actuator 3 shown in FIG. 2 and, in turn, the hydraulic pressure is supplied to the first actuator 9 so that its plunger 10 is projected toward the end of the eccentric lever 7 as shown in FIG. 5B. This projection of the plunger 10 causes the eccentric lever 7 to be pivoted, thus the swing center position 60 of the rocker arm 6A fitted onto the sleeve portion 7B of the eccentric lever 7 being further lowered to a second position ($P_2$) than the position shown in FIG. 1B.

The further lowering of the swing center 60 of the rocker arm 6A means that the further enlargement of the degree of the valve openings during the closure stroke of the exhaust valve. Hence, if the pivotal distance (the pivoted displacement) of the eccentric lever 7 is set so that the degree of the valve openings achieved thereat corresponds to E1 in FIG. 3, it is possible to hold the engine braking force achieved during the relatively high engine revolution speed at its maximum state.

In the above-described embodiment, the two exhaust valves are installed for each engine cylinder and the one of the two exhaust valves to which the decompression braking apparatus is applicable is described, the decompression braking apparatus can be applied to the Diesel engine having one exhaust valve for each engine cylinder.

In the embodiment, the relatively low speed area means the engine revolution speed which is equal to or below 2000 rpm (revolutions per minute) and the relatively high speed area means the engine revolution speed which is above 2000 rpm, the value of the engine revolution speed area boundary may be set according to a characteristic of the engine related to the engine revolution speed.

Figure 6:
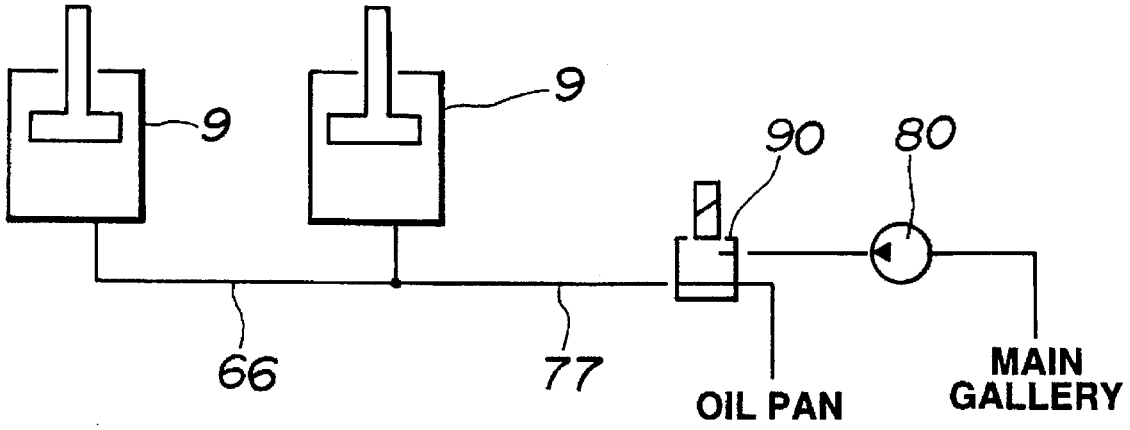
FIG. 6 is a hydraulic pressure supply circuit around each of the first actuators installed in the Diesel engine for explaining an alternative of the embodiment of the decompression braking apparatus.

In addition, FIG. 6 shows two of the first actuators 9 are installed for each cylinder, each having the plunger 10 whose length is different from the other so that the pivotal displacement of the eccentric lever 7 is made different according to the relatively high speed area of the engine revolution speed, with the relatively high speed area being divided into a plurality of speed areas (in this alternative, two).

As described above, with the high speed area further divided into the plurality of relatively high speed areas, the plurality of first actuators may be installed and any one of the first actuators may be operated according to the engine revolution speed which falls in the corresponding relatively high speed divided area of the plurality of engine revolution speed areas.

In FIG. 6, numeral 66 denotes a branch hydraulic pressure line branched from a main hydraulic pressure line 77, numeral 90 denotes a switching solenoid valve and numeral 80 denotes the oil pump.

What is claimed is:

1. A decompression braking apparatus for a Diesel engine, each cylinder of said Diesel engine having a valve train comprising a rocker arm swingably supported by a rocker shaft so as to open and close an exhaust valve with a swing center of said rocker arm as a center, the swing center of said rocker arm being normally aligned with an axial center of said rocker shaft, said decompression braking apparatus comprising:

a) an eccentric bushing member having a sleeve portion pivotally interposed between an inner periphery of a hole of said rocker arm and an outer periphery of said rocker shaft fitted into said hole of said rocker arm so as to be enabled to displace the swing center of said rocker arm in a direction aligned with an opening direction of the exhaust valve;

b) a first actuator having a first plunger whose upper end is enabled to be brought in touch with an end of a sleeve portion of said eccentric bushing member and which is so constructed and arranged as to actuate said eccentric bushing member to be pivoted via said first plunger, thus the swing center of said rocker arm being displaced in a downward direction to a second position aligned with the open direction of said exhaust valve so that a degree of openings of the exhaust valve during a closure stroke is relatively large; and c) a second actuator having a second plunger and which is so constructed and arranged as to project said second plunger to bring said second plunger in touch with the lever portion of said eccentric bushing member such that a pivotal motion of said eccentric bushing member according to the actuation of said first actuator via said first plunger is limited, thus the swing center of said rocker arm being displaced in the downward direction to a first position aligned with the open direction of said exhaust valve so that the degree of the openings of the exhaust valve during the closure stroke is relatively small, said second position being lower than the first position.

2. A decompression braking apparatus for a Diesel engine as claimed in claim 1, wherein each cylinder of said Diesel engine is provided with a bracket which is so constructed and arranged on a cylinder head so as to axially support said rocker shaft, the lever portion of said eccentric bushing member is extended from the sleeve portion thereof toward the exhaust valve, said first actuator is installed on the cylinder head so that said first plunger is vertically projected toward the end of the lower portion of said eccentric bushing member so as to pivot said eccentric bushing member, and said second actuator is installed in said bracket so that said second plunger is horizontally projected from the bracket along the cylinder head so as to bring said second plunger in touch with an upper side of the lever portion of said eccentric bushing member.

3. A decompression braking apparatus for a Diesel engine as claimed in claim 2, wherein said first actuator comprises a hydraulic pressure chamber defined by an outer envelope of said first actuator and said first plunger: a guide member attached on an end of said outer envelope so as to slidably guide a small-diameter portion of said first plunger to project said first plunger from said outer envelope of said first actuator; a first oil passage arranged within said outer envelope of said first actuator so as to supply a hydraulic pressure into said hydraulic pressure chamber from a oil pump of the Diesel engine to push a large-diameter portion of said first plunger to project the first plunger from said outer envelope; and a return spring extended between the large-diameter portion of said first plunger and the guide member so as to return said first plunger toward the hydraulic pressure chamber when the hydraulic pressure chamber via said oil passage is halted.

4. A decompression braking apparatus for a Diesel engine as claimed in claim 3, wherein said second actuator comprises a hydraulic pressure chamber defined by an outer envelope of said second actuator and said second plunger: a guide member attached on an end of said outer envelope so as to slidably guide a small-diameter portion of said second plunger to project said second plunger from said outer envelope of said second actuator; a second oil passage arranged within said outer envelope of said second actuator so as to supply a hydraulic pressure into said hydraulic pressure chamber from the oil pump of the Diesel engine to push a large-diameter portion of said second plunger to project the second plunger from said outer envelope; and a return spring extended between the large-diameter portion of said second plunger and the guide member so as to return said second plunger toward the hydraulic pressure chamber when the hydraulic pressure chamber via said oil passage is halted.

5. A decompression braking apparatus for a Diesel engine as claimed in claim 4, wherein the hydraulic pressure is supplied simultaneously to both of said first and second oil passages of said first and second actuators so that the swing center of said rocker arm is displaced to the first position and wherein the hydraulic pressure is supplied only to the first oil passage of said first actuator so that the swing center of said rocker arm is displaced to the second position.

6. A decompression braking apparatus for a Diesel engine as claimed in claim 1, wherein each cylinder of said Diesel engine has two exhaust valves and wherein the degree of openings in the closure stroke of one of the two exhaust valves is varied according to the pivotal movement of said eccentric bushing member.

7. A decompression braking apparatus for a Diesel engine as claimed in claim 1, wherein said first actuator comprises the same first actuators for each cylinder, each of the first plungers having different lengths of projections from said corresponding first actuators.

* * * * *